US006183309B1

(12) United States Patent
Chiang

(10) Patent No.: US 6,183,309 B1
(45) Date of Patent: Feb. 6, 2001

(54) MOLDED ELECTRICAL RECEPTACLE ASSEMBLY

(76) Inventor: Thomas Shiaw-Cherng Chiang, No. 67, Chung-Yang 2nd Street, Chung-Yang Hsinchun, Hsintien Taipei (TW)

( * ) Notice: Under 35 U.S.C. 154(b), the term of this patent shall be extended for 0 days.

(21) Appl. No.: 09/295,350

(22) Filed: Apr. 26, 1999

(51) Int. Cl.[7] ..... H01R 13/502
(52) U.S. Cl. ..... 439/687; 439/850
(58) Field of Search ..... 439/687, 736, 439/701, 660, 842, 850, 877

(56) References Cited

U.S. PATENT DOCUMENTS 3,569,900 * 3/1971 Uberbacker ..... 439/687
3,742,424 * 6/1973 Startin ..... 439/687
4,043,630 * 8/1977 Superison et al. .
4,398,785 * 8/1983 Hedrick .
4,405,194 * 9/1983 van Lierop .
4,684,191 * 8/1987 Feher et al. .
4,775,332 * 10/1988 Bowden, Jr. et al. .
4,897,052 * 1/1990 Priest et al. .
5,137,474 * 8/1992 Lin .
5,171,168 * 12/1992 Chiodo .
5,378,161 * 1/1995 Loder .
5,486,121 * 1/1996 Miller .
5,560,981 * 10/1996 Ito .
5,616,041 * 4/1997 Brown et al. .
5,655,925 * 8/1997 Pon .
5,975,943 * 11/1999 Chou et al. ..... 439/490

FOREIGN PATENT DOCUMENTS

215094 * 11/1957 (AT) ..... 439/687

* cited by examiner

*Primary Examiner*—Khiem Nguyen
(74) *Attorney, Agent, or Firm*—Tipton L. Randall

(57) ABSTRACT

A novel molded female electrical receptacle assembly is disclosed. The assembly includes an insulating sleeve member containing a pair of female connector members each connected to a conductor wire of a two-wire insulated conductor. The sleeve assembly is enclosed in a body member of insulating thermoplastic. The apertures of the electrical receptacle that accept the blades of an electrical plug are designed with inwardly tapering walls in register with a flanged end opening of the female connector member contained therein.

10 Claims, 7 Drawing Sheets

MOLDED ELECTRICAL RECEPTACLE ASSEMBLY

FIELD OF THE INVENTION

The invention relates to an electrical receptacle and, more particularly, to a molded female electrical receptacle having tapered openings and tapered connectors.

BACKGROUND OF THE INVENTION

Electrical receptacles are common devices fastened to an end of an electrical conductor wire to allow connection with another electrical conductor wire that is fitted with an electrical plug. The receptacle contains a plurality of apertures, each of which access one conductor strand of the conductor wire. Each conductor wire is fastened to some type of coupling connector that is held within the receptacle at each aperture. FIG. 1 shows an example of one type of coupling connector that is fastened to a conductor wire. The plug contains a like number of blades, each of which is fastened to one conductor strand of the other conductor wire. Inserting the plug blades into the receptacle apertures, and the coupling connectors therein, connects the conductor strands of the two conductor wires, thereby making an electrical connection. In FIG. 1 the plug blade enters the vertical slot adjacent the two curved sections C of the coupling connector.

Many receptacles and plugs are produced separately and then fastened by hand to each conductor wire to provide suitable electrical connection for the conductor wires. A more permanent connector system employs molding of an electrically insulating plastic or rubber receptacle or plug directly on the end of a conductor wire. The coupling connectors or plug blades are first fastened to each strand of the conductor wire, then the outer covering is formed over the wire with blades or the coupling connector fastened thereto. Injection molding of the receptacle or plug end coverings of wires employs a molten thermoplastic material injected into a mold containing the appropriate wires with the appropriate connector end fastened thereto. The production of a receptacle generally employs some type of pin, positioned at each coupling connector, to form the aperture that later accepts the plug blade. After the thermoplastic material sets or cools, the mold and pins are removed, releasing the resulting receptacle or plug end of the wire.

The thermoplastic materials used to form the plug and the receptacle undergo shrinkage in the transformation from a hot molten condition to a cool solidified condition during the molding process. The magnitude of shrinkage for the thermoplastic materials is found to vary with the specific material used, as well as the process temperature and the environmental conditions present during production. Variation in material shrinkage causes variation in dimensions between the plug blades and, most importantly between the apertures accessing the coupling connectors within the receptacle. This problem is particularly important when producing small dimension receptacles and plugs. The plug blades extending from the molded plug provide some degree of adjustment by slight bending. The receptacle apertures and internal connectors cannot be adjusted to any degree. Thus, the molded receptacle requires production with high precision. Some examples of inventions concerned with electrical receptacles and plugs have been granted patents.

Suverison et al., in U.S. Pat. No. 4,043,630, disclose a molded plug connection including a preformed insert shown in detail in FIGS. 2–6. The insert has a front plate with four spaced apertures which each align with one of four spaced channels in the elongated turret .

U.S. Pat. No. 4,398,785 by Hedrick shows an inner body which is injection-molded about the contacts and the connectors which are attached to the contacts. Thereafter, an outer cover is injection-molded about the inner body.

In U.S. Pat. No. 4,405,194, van Lierop describes a premolded insert arrangement including a base holding a space connector pin. The base has a recess for receiving a fuse holder. The cap prevents liquid plastic from flowing into the fuse recess during injection molding of the plug body.

Feher et al., in U.S. Pat. No. 4,684,191, describe an electrical connector assembly having contact springs with an outward flare. A fork has tines defining a flared receptacle guiding mouth for receiving a bus bar.

Bowden, Jr. et al., in U.S. Pat. No. 4,775,332, disclose an electrical receptacle having terminals with a pair of grasping members to receive an electrical plug blade. The grasping members taper toward the open end and then flare outwardly.

In U.S. Pat. No. 4,897,052, Priest et al. describe an intermediate electrical component including a two-piece plastic insulating shell having a molded body portion for receiving a plurality of terminal elements and a molded cap portion for enclosing the terminal partially within the body portion and the cap portion. The cap portion is slidably inter-fitted with the body portion. Conductor wires are fastened to power blades, each with a blade section and a pair of resilient leaves, with the leaves adapted to receive another blade. The blades are fitted into the two piece insulating shell and the unit is covered with suitable insulating material by injection molding.

U.S. Pat. No. 5,137,474 by Lin discloses an AC electrical socket structure having conductive strips with U-shaped insertion folds held in place by mounting brackets. The folds are for receiving electrical plug blades.

Chiodo, in U.S. Pat. No. 5,171,168, describes an electrical "piggyback" plug made with a pair of unitary prong-socket members (FIGS. 1–4) having flat socket fingers and a gap there between for receiving a plug blade. The prongs and sockets of the plug are oriented at a 90-degree angle in the molded dielectric plastic body.

U.S. Pat. No. 5,378,161 by Loder shows an electrical connector with tapered male and female surfaces for use with a ribbon cable. The male connector has one conductor, and the female connector has several conductors.

Miller, in U.S. Pat. No. 5,486,121, discloses an electrical connector assembly with a socket subassembly and a distribution assembly. The socket assembly has socket busses with slits for receiving blades of electrical plugs.

In U.S. Pat. No. 5,560,981, Ito describes a double molded connector including a connector portion and an inside-outside communication portion which folds on itself to retain conductor strands in channels. The connector portion and inserted conductor strands of FIG. 7 are molded with insulating resin to produce a finished double molded connector of FIGS. 8 and 9.

Brown et al., in U.S. Pat. No. 5,616,041, discloses a female connector for a plastic molded receptacle. The female connector has a first arm and a second arm with a slot between them. A third arm and a fourth arm are perpendicular to the first and second arms and have a slot between them also. A crimping end secures the conductor wire to the female connector. The first slot includes chamfers at the rounded end, while the third and fourth arms have bent away ends. The slots each can accept a blade from an electrical plug. Two female connectors are employed in a molded receptacle shown in FIGS. 12–15.

In U.S. Pat. No. 5,655,925, Pon describes a female plug that includes an insulating base bracket, two symmetrical contact blades fastened to the base block, an insulating housing covering the block to hold the blades in place, and a two-line electrical wire inserted though a flange rear port on the housing and connected to the contact blades. The base block has a pair of rectangular holes that accept a pair of blades from a male plug, the plug blades contacting the contact blades of the female plug.

Thus, there is an unmet need for an electrical receptacle that can be produced by injection molding techniques with a high degree of dimensional stability in the resulting receiving apertures.

SUMMARY OF THE INVENTION

The invention outlined in the disclosure is a molded female receptacle for receiving a male plug. The receptacle includes a pair of a female connector member of electrical conductor material including a U-shaped section with first and second ends with vertical sides and a transverse top section. The U-shaped section first end vertical sides are flanged outwardly to enlarge the connector U-shaped section first end, and a linear section extends from the transverse top section of the U-shaped section second end, with the linear section having first and second pairs of crimping arm members. The first pair of arm members is sized to crimp on a conductor wire and the second pair of arm members is sized to crimp on an insulated conductor wire.

An insulating sleeve member includes a rectangular plastic base member with first and second ends and having a pair of open top chambers therein separated by a central open top channel. The base member first end has a pair of rectangular apertures, each aperture accessing one of the open top chambers. The apertures taper from exterior to interior the chamber. The base member second end has a pair of positioning slots, each slot accessing one of the open top chambers and adapted to accommodate a portion of the connector linear section adjacent the connector U-shaped section second end. A rectangular plastic cap member sized to cover the base member pair of open top chambers and open top channel is present. The cap member has interlocking means for engaging the base member central channel, thereby fastening the cap member thereto.

A pair of female connector members, each fastened to one wire of a two wire conductor by the two pairs of crimping arm members, are positioned each in one base member open top chamber with the first end outwardly flanged vertical sides in register with the tapered opening therein. Each connector member linear section is positioned in the chamber positioning slot, with the connector members secured therein by the interlocking cap member. The crimped conductor wires are positioned exterior the insulated sleeve member.

In addition, a body member of molded insulating material surrounds the insulating sleeve member with a pair of female connector members therein. The molded body member has a pair of rectangular apertures with inwardly tapering sides, each tapered aperture in register with an insulating sleeve tapered aperture and the outwardly flanged first end of a U-shaped section of a female connector member therein. The insulated conductor wire extends from the molded body member.

DESCRIPTION OF THE PREFERRED EMBODIMENTS

Nomenclature

Figure 1:
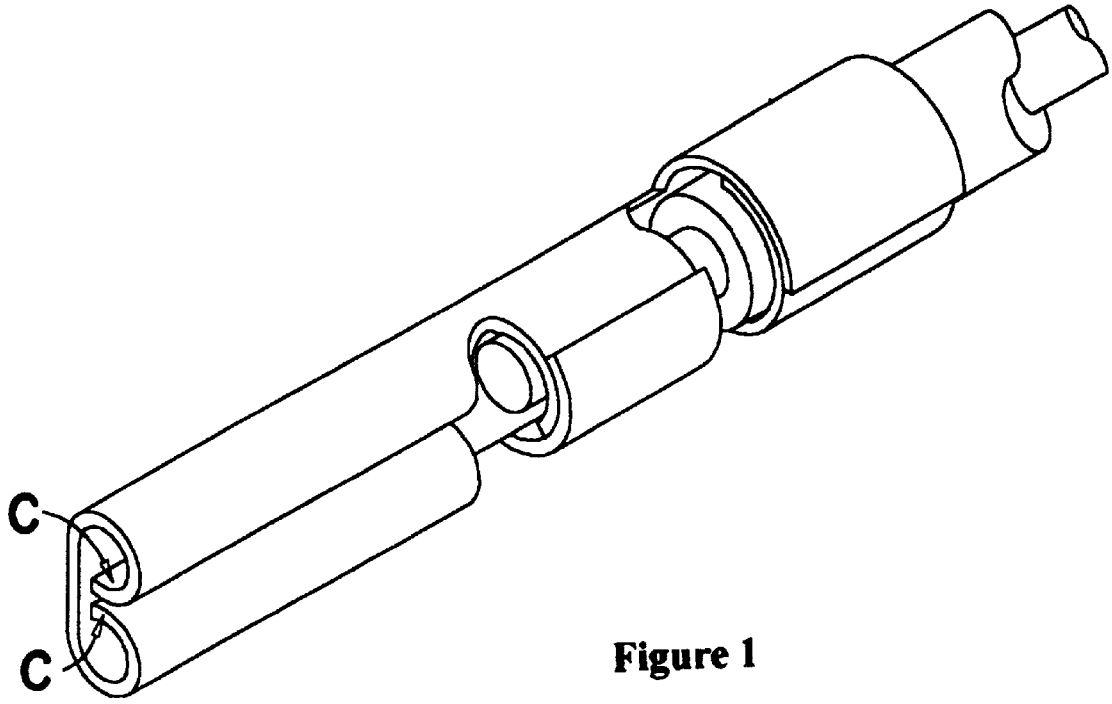
Figure 1 Prior Art
FIG. 1 is an elevational perspective view of a female connector member according to the prior art.
Figure 2:
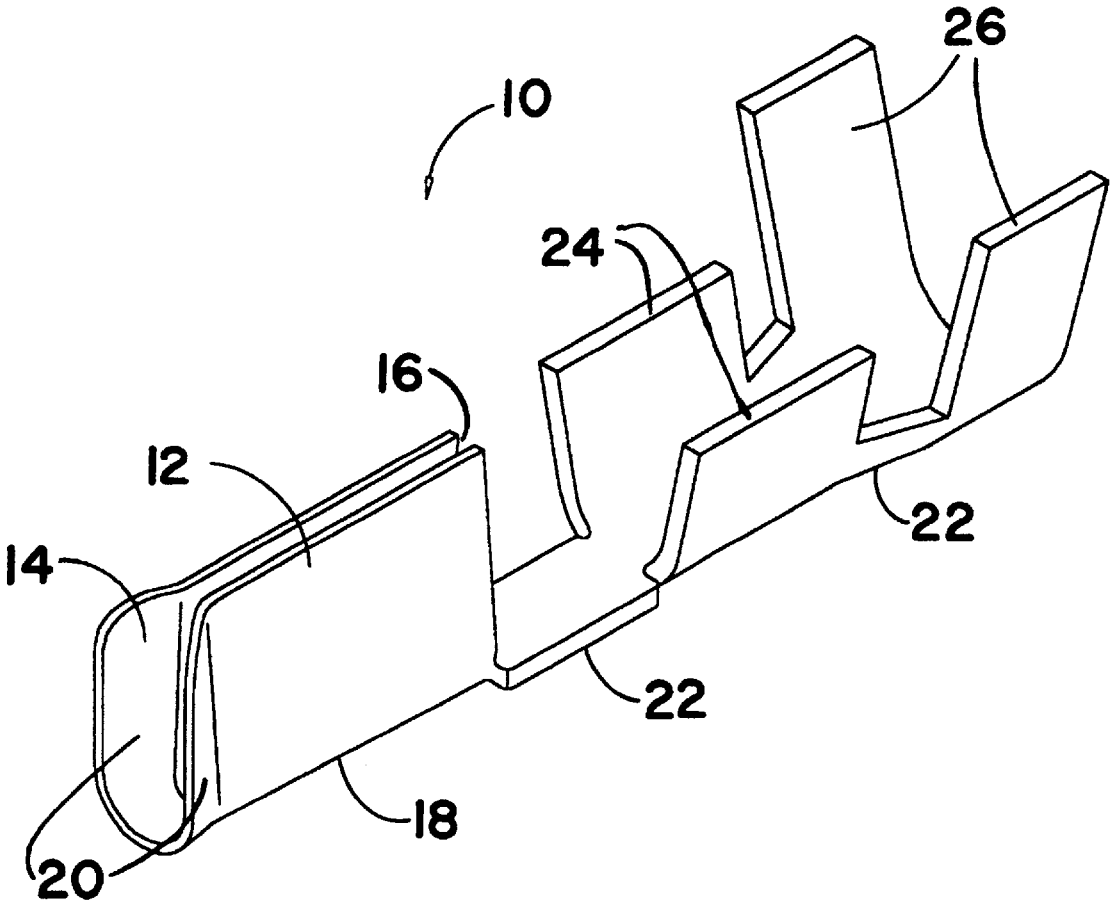
FIG. 2 is an elevational perspective view of the female connector member of the present invention.

10 Female Connector Member
12 U-Shaped Section of Connector Member
14 First End of U-Shaped Section
16 Second End of U-Shaped Section
18 Transverse Bottom Section of U-Shaped Section
20 Flanged Vertical Sides of First End
22 Linear Section of Connector Member
24 First Pair of Crimping Arm Members
26 Second Pair of Crimping Arm Members
28 Conductor Wire Member
30 Insulated Covering of Conductor Wire
32 Two-Wire Insulated Conductor
50 Insulating Sleeve Member
52 Base Member of Sleeve
54 First End of Base Member
56 Second End of Base Member
58 Open Top Chambers
60 Open Top Channel
62 Overhanging Top Edges of Channel
64 Tapered Apertures in Base Member First End
66 Guide Way Opening in Base Member First End
68 Positioning Slots in Base Member Second End
70 Cap Member of Sleeve
72 Top of Cap Member
74 Bottom of Cap Member
76 J-Shaped Interlocking Leg Portions of Cap Member
78 Hook Ends of Leg Portions
80 Guide Way Channel of Cap Member
82 Overlapping Ends of Cap Member
84 Grooves in Top of Base Member
100 Molded Female Electrical Receptacle Assembly
110 Body Member of Molded Insulating Material
112 Rectangular Apertures in Body Member
114 Inwardly Tapering Sides of Apertures
200 Molded Female Electrical Receptacle Assembly
210 Body Member of Molded Insulating Material
212 Rectangular Apertures in Body Member
214 Inwardly Tapering Sides of Apertures Construction Referring to FIG. 2, the female connector member 10 of the present invention is shown. The connector member 10 is made of an electrically conductive material such as copper, brass or ferrous based alloy. The connector member 10 has a U-shaped section 12 with a first end 14 and a second end 16 and a transverse bottom section 18. The U-shaped section first end 14 has vertical sides 20 that are flanged outwardly to enlarge the connector member first end 14 to more readily accept an electrical blade from a male plug. A connector linear section 22 extends from the traverse bottom section 18 of the second end 16 of the U-shaped section 12. The linear section 22 has a first pair of crimping arm members 24 positioned adjacent the U-shaped section 12, and a second pair of crimping arm members 26 positioned opposite the U-shaped section 12 and at the end of the connector member 10. Both crimping arm pairs 24, 26 are co-linear with the connector U-shaped section 12. The crimping arm pairs 24, 26 are used to securely attach an insulated electrical conductor wire to the female connector member 10. The first pair of crimping arm members 24 are sized to accept and crimp upon a bare conductor wire member 28. The second pair of crimping arm members 26 are sized to accept and crimp upon a conductor wire member 28 with an insulation covering 30. Consequently, the first pair of crimping arm members 24 are smaller than the second pair of crimping arm members 26.

Figure 3:
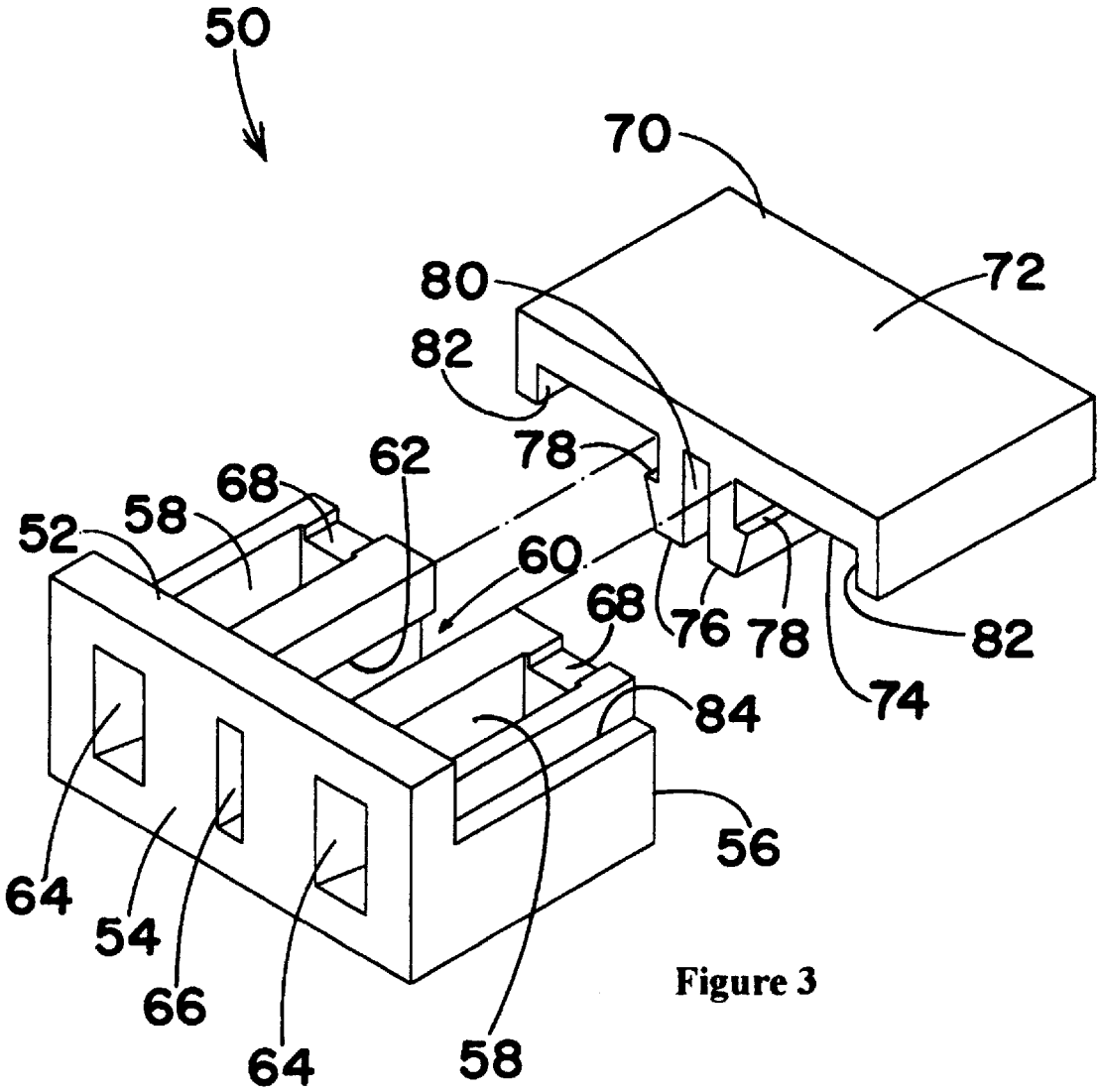
FIG. 3 is an elevational perspective view of the base member and top member of the insulating sleeve member of the present invention.
Figure 4:
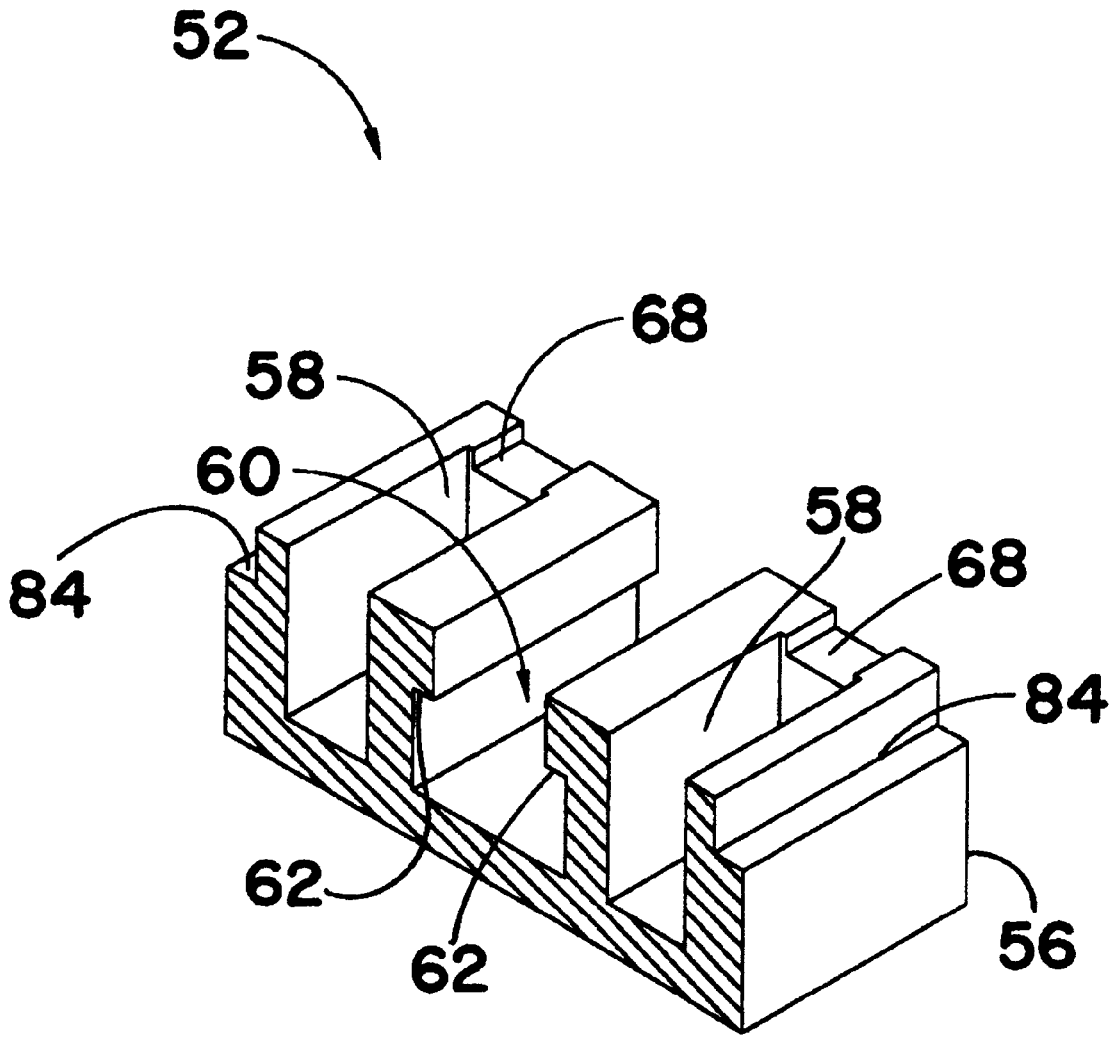
FIG. 4 is a perspective view of the second end of the base member of the present invention.
Figure 5:
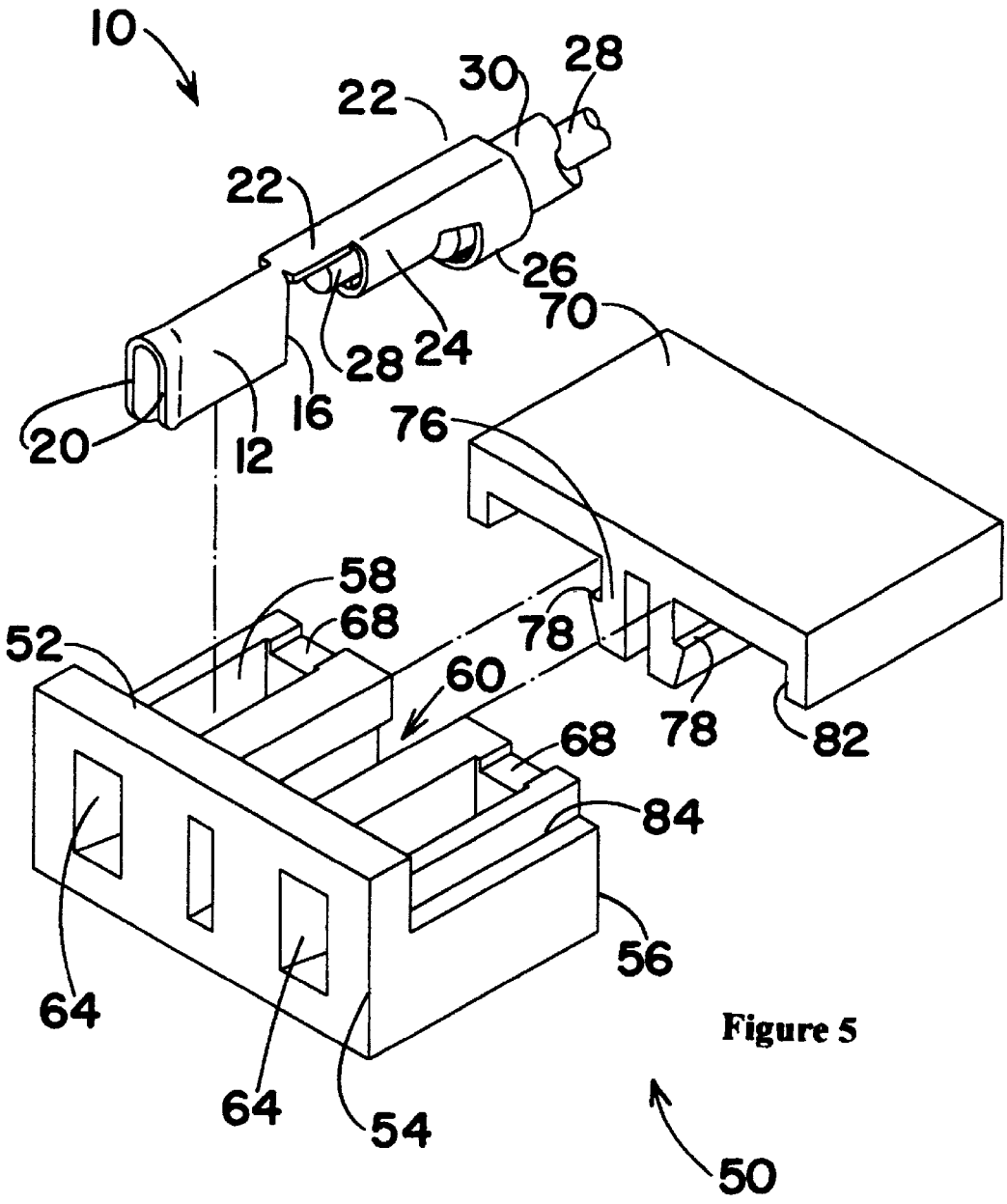
FIG. 5 is a perspective view of the female connector member and the insulating sleeve member of the present invention.

Referring to FIG. 3, the insulating sleeve member 50 of the present invention is shown. The sleeve member 50 is preferably made of a plastic material and includes a generally rectangular base member 52 with a first end 54 and a second end 56, and having a pair of open top chambers 58 therein separated by an open top channel 60, which is also open to the base member second end 56. The first end 54 of the base member 52 extends slightly above the open top chambers 58 therein. The overhanging top edges 62 of the channel 60 are designed for interlocking with the cap member as described below. The base member first end 54 has a pair of generally rectangular apertures 64, with each aperture 64 accessing one of the open top chambers 58. The rectangular apertures 64 taper from exterior to interior of the base member first end 54. Also included in the base member first end 54 is a guide way opening 66 that accesses the open top channel 60. The base member second end 56 contains a pair of positioning slots 68, with each slot 68 accessing one of the open top chambers 58. Each slot 68 is located at the top edge of the base member second end 56. The base member second end 56 is shown in more detail in FIG. 4. The open top chambers 58 are sized to accept the U-shaped section 12 of the female connector member 10 with the linear section 22 of the connector member 10 positioned in the base member positioning slot 68 as shown in FIG. 5. The attached conductor wire member 28 and pairs of crimping arm members 24, 26 are thereby positioned exterior the insulating sleeve member 50. The female connector member 10 of FIG. 2, with attached conductor wire member 28, is inverted for insertion into one base member chamber 58 as depicted in FIG. 5. The tapered apertures 64 are sized to prevent the U-shaped section 12 of the connector member 10 from entering the aperture 64.

Referring again to FIG. 3, the insulating sleeve member 50 also includes a generally rectangular cap member 70 sized to cover the base member pair of open top chambers 58 and open top channel 60. The cap member 70 has interlocking means for engaging the base member open top channel 60, thereby securely fastening the cap member thereto. The cap member 70 has top 72 and bottom 74 sides, with the interlocking means comprising a pair of J-shaped leg portions 76 that extend from the cap member bottom side 74 and extend the full length of the cap member 70. The hook-like ends 78 of the J-shaped leg portions 76 are oriented in opposite directions with a guide way channel 80 separating the leg portions 76. The pair of J-shaped leg portions 76 fit into the base member open top channel 60 with the hook-like ends 78 interlocking with the overhanging top edges 62 of the channel. Additionally, the cap member 70 may contain downward turned edges 82 which fit into corresponding grooves 84 in the top of the base member 50 for a secure fit. The cap member 70 may be positioned on the base member 52 by sliding the cap member 70 on from the base member second end 56 with the cap member leg portions 76 entering the open end of the channel 60. Alternatively, the cap member 70 may be snapped into position from above the base member 52 with the hook ends 78 of each leg portion 76 deflecting around the channel overlapping top edges 62, and then interlocking therewith.

Figure 6:
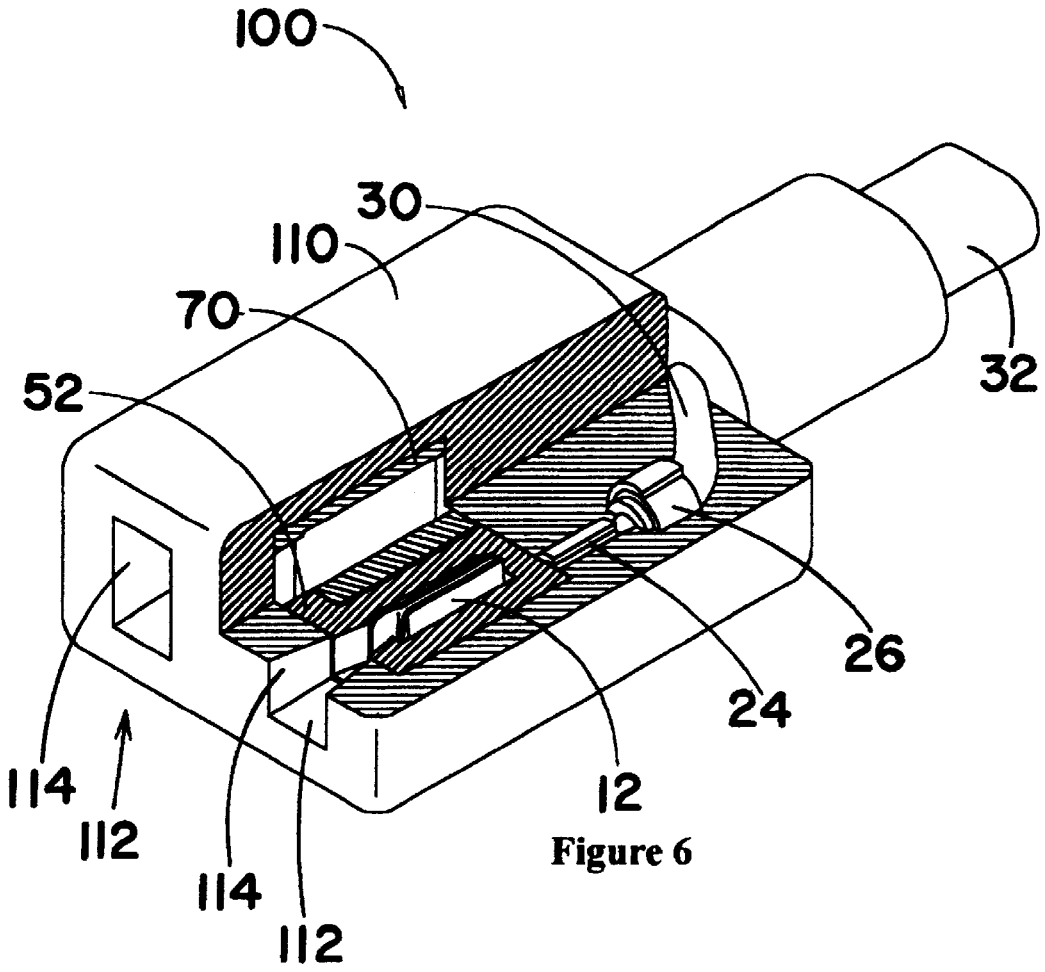
FIG. 6 is a perspective partial cut away view of the molded female receptacle of the present invention.

To form the molded female electrical receptacle assembly 100, the sleeve assembly 50 with U-shaped portions 12 of a pair of connector members 10 positioned therein, with each connector 10 fastened to one wire of an insulated two-wire conductor 30, is encased in a molded insulating material of any desired shape, producing the assembly 100. Referring to FIG. 6, the body member 110 of molded insulating material is produced by conventional molding techniques as described above. The body member 110 is produced with a pair of generally rectangular apertures 112 with inwardly tapering sides 114 by inserting appropriately tapered pins into the apertures 64 of the sleeve member 50. Each aperture 112 produced is positioned in register with a tapered aperture 64 in the first end 54 of the insulating sleeve base member 52, with the U-shaped section 12 of a connector member 10 contained therein. Thus, the molded female receptacle assembly 100 contains a pair of apertures 112, which taper to the flanged edge 20 of the connector 10. A cut away view of the completed female receptacle assembly 100 is shown in FIG. 6, with the two-wire insulated conductor member 32 protruding from the end of the molded body member 110 opposite the pair of apertures 112. The tapering of all apertures and connector ends provides for extremely simple insertion of the blade members of an electrical plug into the apertures of the female receptacle assembly 100.

The insulating sleeve member 50 securely holds the female connector member 10 in position during the molding process and prevents molten molding thermoplastic from entering the chambers 58 of the sleeve member 50 containing the U-shaped sections 12. The tapered pins of the mold die also seal the sleeve apertures 64 from the molten thermoplastic. The guide way opening 66 in the base member first end 54, and the guide way channel 80 of the cap member 72, provide a pathway for the flow of molten molding thermoplastic into and through the channel 60 of the sleeve member 50 during the molding process. The insulating sleeve member 50 with contained female connector members 10 prevents movement of the female connector members 10 during the molding process, thereby producing a dimensionally consistent female electrical receptacle assembly 100. Additionally, the tapered apertures 114 of the molded body member 110, the sleeve tapered apertures 64 and the flanged ends 20 of the connector member 10 all provide an unimpeded opening that readily accepts the blade of an electrical plug inserted therein.

Figure 7:
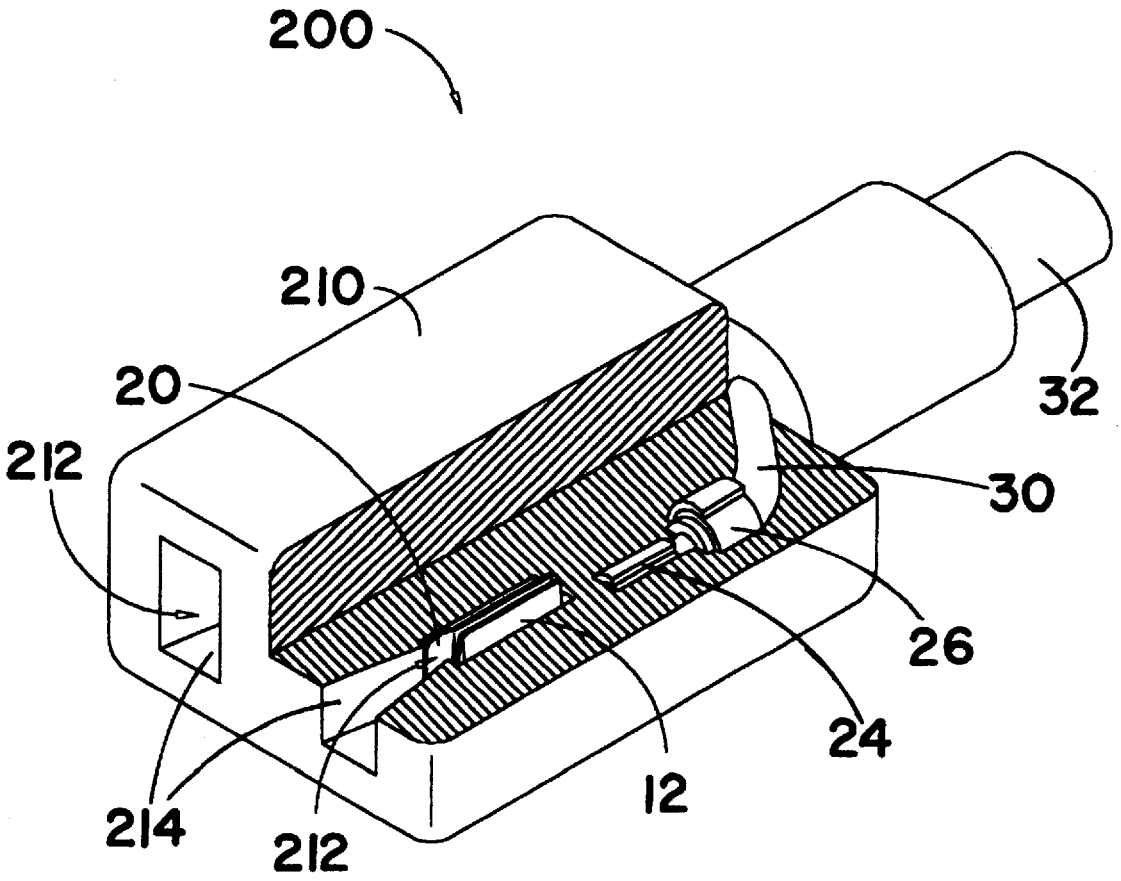
FIG. 7 is a perspective partial cut away view of an alternative embodiment of the molded female receptacle of the present invention.

In some situations, the insulating sleeve assembly 50 is not needed to accommodate the female connector members 10 of the molded assembly. In an alternative embodiment of the invention, shown in FIG. 7, a molded female receptacle assembly 200 is shown in cut away view. In this embodiment the pair of female connector members 10, with U-shaped sections 12 having flared vertical sides 20 at a first end 14, are connected to each wire 30 of a two-wire insulated conductor 32 by means of the pairs of crimping arm members 24, 26 on each connector 10. The connectors 10 and attached conductor wires 30 are encased within a molded insulating body member body 210. In this embodiment, a tapered pin of the die mold is inserted into the flanged end 20 of each female connector member 10 with connected conductor wire 30 attached thereto. After injection of the molten thermoplastic material and solidification of the material, the mold and accompanying pins are removed to produce the molded female receptacle assembly 200 shown in cut away view in FIG. 7. Again, the body member 210 is produced with a pair of generally rectangular apertures 212 with inwardly tapering sides 214. Each aperture 212 is positioned in register with the U-shaped section 12 of a connector member 10 contained therein. The insulated conductor wire 32 adjacent the connector members 10 is also encased in the body member 210, and protrudes from the body member 210 opposite the tapered apertures 212 therein.

While the invention has been particularly shown and described with reference to a preferred embodiment thereof, it will be understood by those skilled in the art that various changes in form and details may be made therein without departing from the spirit and scope of the invention.

I claim:

1. An insulating sleeve member comprising;

(a) a rectangular plastic base member with first and second ends and having a pair of open top chambers therein separated by a central open top channel, said base member first end having a pair of rectangular apertures, each aperture accessing one of said open top chambers, said apertures tapering from exterior said chamber to interior said chamber, said base member second end having a pair of positioning slots, each slot accessing one of said open top chambers; and (b) a rectangular plastic cap member sized to cover said base member pair of open top chambers and open top channel, said cap member having interlocking means for engaging said base member central channel, thereby fastening said cap member thereto.

2. The insulating sleeve member according to claim 1 wherein, said each positioning slot of said insulating sleeve member is located at a top edge of one open top chamber at said base member second end.

3. The insulating sleeve member according to claim 1 wherein, said insulating sleeve interlocking means comprises a pair of J-shaped leg sections protruding from a bottom side of said cap member, said leg sections engaging a pair of overlapping top edges of said base member open top channel upon insertion of said cap member leg sections into said base member open top channel.

4. A connector and insulating sleeve assembly for attachment to a two wire insulated conductor comprising;

(a) a female connector member of electrical conductor material including a U-shaped section with first and second ends with vertical sides and a transverse bottom section, said U-shaped section first end vertical sides flanged outwardly to enlarge said connector U-shaped section first end, and a linear section extending from said transverse bottom section of said U-shaped section second end, said linear section having first and second pairs of crimping arm members, said first pair of arm members sized to crimp on a conductor wire and said second pair of arm members sized to crimp on an insulated conductor wire; and (b) an insulating sleeve member comprising;

(i) a rectangular plastic base member with first and second ends and having a pair of open top chambers therein separated by a central open top channel, said base member first end having a pair of rectangular apertures, each aperture accessing one of said open top chambers, said apertures tapering from exterior said chamber to interior said chamber, said base member second end having a pair of positioning slots, each slot accessing one of said open top chambers and adapted to accommodate a portion of said connector linear section adjacent said connector U-shaped section second end, and (ii) a rectangular plastic cap member sized to cover said base member pair of open top chambers and open top channel, said cap member having interlocking means for engaging said base member central channel, thereby fastening said cap member thereto;

(c) whereby a pair of female connector members, each fastened to one wire of a two wire insulated conductor by said two pairs of crimping arm members, are positioned each in one base member open top chamber with said first end outwardly flanged vertical sides in register with said tapered opening therein, each connector member linear section positioned in said chamber positioning slot, said connector members secured therein by said interlocking cap member, both of said pairs of crimping arms and attached conductor wire positioned exterior said insulating sleeve member.

5. The connector and insulating sleeve assembly according to claim 4 wherein, said each positioning slot of said insulating sleeve member is located at a top edge of one open top chamber at said base member second end.

6. The connector and insulating sleeve assembly according to claim 4 wherein, said insulating sleeve interlocking means comprises a pair of J-shaped leg sections protruding from a bottom side of said cap member, said leg sections engaging a pair of overlapping top edges of said base member open top channel upon insertion of said cap member leg sections into said base member open top channel.

7. A molded female receptacle assembly for attachment to a two wire insulated conductor comprising:

(a) a female connector member of electrical conductor material including a U-shaped section with first and second ends with vertical sides and a transverse bottom section, said U-shaped section first end vertical sides flanged outwardly to enlarge said connector U-shaped section first end, and a linear section extending from said transverse bottom section of said U-shaped section second end, said linear section having first and second pairs of crimping arm members, said first pair of arm members sized to crimp on a conductor wire and said second pair of arm members sized to crimp on an insulated conductor wire;

(b) an insulating sleeve member comprising;

(i) a rectangular plastic base member with first and second ends and having a pair of open top chambers therein separated by a central open top channel, said base member first end having a pair of rectangular apertures, each aperture accessing one of said open top chambers, said apertures tapering from exterior to interior, said base member second end having a pair of positioning slots, each slot accessing one of said open top chambers and adapted to accommodate a portion of said connector linear section adjacent said connector U-shaped section second end; and (ii) a rectangular plastic cap member sized to cover said base member pair of open top chambers and open top channel, said cap member having interlocking means for engaging said base member central channel, thereby fastening said cap member thereto;

(c) whereby a pair of female connector members, each fastened to one wire of a two wire insulated conductor by said two pairs of crimping arm members, are positioned each in one base member open top chamber with said first end outwardly flanged vertical sides in register with said tapered opening therein, each connector member linear section positioned in said chamber positioning slot, said connector members secured therein by said interlocking cap member, both of said pairs of crimping arms and attached conductor wire positioned exterior said insulated sleeve member; and (d) a body member of molded insulating material surrounding said insulating sleeve member with a pair of female connector member therein, said molded body member having a pair of rectangular apertures with inwardly tapering sides, each tapered aperture in register with an insulating sleeve tapered aperture and the outwardly flanged first end of a U-shaped section of a female connector member therein, the insulated conductor wire extending from said molded body member.

8. The molded female receptacle assembly according to claim 7 wherein, said each positioning slot of said insulating sleeve member is located at a top edge of one open top chamber at said base member second end.

9. The molded female receptacle assembly according to claim 7 wherein, said insulating sleeve interlocking means comprises a pair of J-shaped leg sections protruding from a bottom side of said cap member, said leg sections engaging a pair of overlapping top edges of said base member open top channel upon insertion of said cap member leg sections into said base member open top channel.

10. A molded female receptacle assembly for attachment to a two wire insulated conductor comprising;

(a) first and second female connector members of electrical conductor material, each connector member including a U-shaped section with first and second ends with vertical sides and a transverse bottom section, said U-shaped section first end vertical sides flanged outwardly to enlarge said connector U-shaped section first end, and a linear section extending from said transverse bottom section of said U-shaped section second end, said linear section having first and second pairs of crimping arm members, said first pair of arm members adapted for crimping on a conductor wire of a two wire conductor, and said second pair of arm members adapted for crimping on an insulated conductor wire of the two wire conductor; and (b) a body member of molded insulating material encasing said first and second female connector members attached to a two wire conductor, said molded body member having first and second ends with said body member first end having a pair of rectangular apertures with inwardly tapering sides, each tapered aperture in register with an outwardly flanged first end of one U-shaped section of a female connector member embedded within said body member, the two wire conductor extending from said second end of said molded body member.

* * * * *